US007076851B2

(12) United States Patent
Rousset

(10) Patent No.: US 7,076,851 B2
(45) Date of Patent: Jul. 18, 2006

(54) HAND TOOL FOR INSERTING AND REMOVING RAIL FASTENINGS

(75) Inventor: Bernard Rousset, Auriol (FR)

(73) Assignee: Societe Des Anciens Establissements Luciens Geismar, Neuilly S/Seithe (FR)

( * ) Notice: Subject to any disclaimer, the term of this patent is extended or adjusted under 35 U.S.C. 154(b) by 133 days.

(21) Appl. No.: 10/885,000

(22) Filed: Jul. 7, 2004

(65) Prior Publication Data

US 2005/0028343 A1 Feb. 10, 2005

(30) Foreign Application Priority Data

Jul. 8, 2003 (FR) ..... 03 08336

(51) Int. Cl.
*B23P 19/04* (2006.01)

(52) U.S. Cl. ..... 29/252; 29/255

(58) Field of Classification Search ..... 29/252, 29/255, 261, 267; 254/93 H, 89 H, 93 R
See application file for complete search history.

(56) References Cited

U.S. PATENT DOCUMENTS 4,074,411 A * 2/1978 Willard et al. ..... 29/267
5,233,740 A * 8/1993 Chen ..... 29/252
6,665,918 B1 * 12/2003 Williams ..... 29/259
2005/0028343 A1 * 2/2005 Rousset ..... 29/428

FOREIGN PATENT DOCUMENTS

FR 2 659 674 9/1991
JP A 2000 038704 2/2000

* cited by examiner

*Primary Examiner*—Lee D. Wilson
(74) *Attorney, Agent, or Firm*—Oliff & Berridge, PLC

(57) ABSTRACT

A hand tool designed for installing and extracting the elastic fastenings of railroad rails. The hand tool comprises a base body, mounted movably to the underside of which is an active part which acts on the fastening that is to be inserted or removed. A rotating head or a rotating part that can be pivoted about an essentially vertical axis is provided on the top of the main body, the head carrying a hand-powered member, such as a push bar, which extends to the side of the head. A force-multiplying transmission, which may for example be hydraulic, connects the hand-powered member to the active part. In this way the hand-powered member can, independently of the use position of the active part, be placed in a suitable orientation, particularly inside a safe zone.

19 Claims, 4 Drawing Sheets

HAND TOOL FOR INSERTING AND REMOVING RAIL FASTENINGS

The present invention relates to a hand tool for inserting and removing fastenings of railroad rails, this tool being more particularly designed for installing and extracting the elastic fastenings of rails, also known in the trade as clips.

BACKGROUND OF THE INVENTION

Such removable fastenings are inserted into a fixed support embedded in a tie in the railroad to hold the rail in place. These fastenings are applied to both the inner and outer flanges of the rail foot, i.e. the bottom part of the rail which is laid on the ties.

DESCRIPTION OF THE PRIOR ART

Three categories of equipment are currently known for inserting and removing such rail fastenings:

a) some are highly efficient self-propelled machines which travel along the actual rails of the railroad, carrying the machine driver with it. The power for moving and working the machine is supplied by a heat engine and by a high-power hydraulic power unit, both on board the machine;

b) some are lightweight machines with a heat engine or electric motor and with hydraulic movement, the driver walking on foot i.e. on the ground alongside the machine. The power source for such a machine is a small industrial motor connected to a hydraulic power unit, usually producing less than 15 kW output. As an example of this kind of machine, reference is made to French patent FR 2 659 674;

c) lastly, hand tools using the lever principle to apply a force, derived from human energy only, of around two tons to the fastening to insert or remove it, are known. These hand tools generally work in a purely mechanical manner.

The present invention is concerned with this last category of equipment, i.e. hand tools for inserting and removing rail fastenings. It seeks to avoid the problems of existing hand tools, said problems being as follows:

- present-day hand tools require the operator to step from one side of the rail to the other while using them in order to work either on an inner fastening or an outer fastening. To this is added the fact that these tools have quite a long drive arm to enable the operator to exert enough force, in accordance with the lever principle of said tools. As a result, the operator is between the two rails of the railroad for half the time, but also for half the time he is outside the rails. If he is working on a double or multiple track, the operator is thus moving outside of the gage of the track to be worked on and is entering the gage of the adjacent track, which is a dangerous situation from the point of view of personal safety, because there may be trains traveling on this adjacent track (even if the track to be worked on is of course not in use);
- existing hand tools are specialized for a single task, that is they are tools that can only insert or only remove fastenings. Two different types of tool must therefore be available, and must be used alternately depending on whether one is inserting or removing a fastening;
- owing to the fact that their principle of operation is purely mechanical (with a lever), present-day hand tools continue to be hard work, and yet with a given driving movement still produce only a limited working stroke. Clearly, it is desirable to be able to position the fastenings in different positions with respect to the rail, but at the very least this means that the active part of the tool has to be changed to reach these different positions, and it may make it necessary to change the whole tool to cope with all the positions encountered in practice.

It is therefore the object of the present invention to eliminate all of the problems set out above by providing a hand tool for inserting and removing rail fastenings, of the type discussed here, which in particular significantly improves the safety of the tool operator; which also allows fastenings to be inserted and removed with equal convenience without either modifying or replacing the tool; and which furthermore greatly reduces the difficulty of the operator's work, for the same force on the active part of the tool, while offering this active part a much greater stroke, allowing very variable positions of the fastenings with respect to the rail, without changing said active part.

To this end, the subject of the invention is a hand tool for inserting and removing rail fastenings for railroads, particularly for installing and extracting inner or outer elastic fastenings, which essentially comprises, in combination:

- a main body,
- an active part designed to act on a fastening that is to be inserted or removed, the active part being mounted movably underneath the main body,
- at the top of the main body, a rotating head or rotating part that can be pivoted about an essentially vertical axis,
- a hand-powered member, such as a push bar, mounted or mountable on the rotating head or rotating part and extending to the side of this rotating head or rotating part,
- a force-multiplying transmission between the hand-powered member and the active part,
- the rotating head or rotating part being positionable angularly independently of the use position of the active part, in such a way as to place the hand-powered member in a suitable orientation, particularly within a safe zone.

In a preferred embodiment of the invention, the main body of the hand tool for inserting and removing rail fastenings comprises, on the one hand, a base block housing a hydraulic ram, the moving part of which is connected to the active part designed to act on the fastening that is to be inserted or removed, and on the other hand a rotating part that surmounts the base body and encloses a hydraulic power unit with an oil reservoir and a pump, in communication with the hydraulic ram, the rotating part being provided at its top with a head provided with a device for the hand operation of the pump, with a hand-powered member such as a push bar, and transmission parts between this power member and the moving part of the pump.

Advantageously, the hydraulic ram comprises a fixed cylinder, housed in the base block of the main body, and a sliding piston which possesses an outer end to which the active part is removably and interchangeably fixed.

As far as the hand-operated device is concerned, this may be constructed with a lever able to move in an essentially vertical plane, one arm of which is designed to take the hand-powered member such as the push bar, and one point of which is connected to a plunger piston of a pump set essentially vertically, in the axis of the rotating part. Another point of the lever may be connected in a hinged manner, via a link, to the head of the rotating part.

Altogether, the result is thus a hand tool for inserting and removing rail fastenings which combines the following advantages:

whether inserting or removing an inner fastening or an outer fastening, the rotating head of the tool can always be oriented, using the drive member such as the push bar, toward the zone between the two rails of the railroad where the work is being done, so that the operator is always positioned between these two rails and therefore within the gage of the track on which he is working, and not in the gage of an adjacent track. This is a substantial safety improvement;

the hand tool forming the subject-matter of the invention can be used to both insert and remove fastenings with equal convenience, without changing the tool, simply by rotating the hand tool to the appropriate side so that the active part is in its correct position of use, and of course with the safety of the operator maintained as explained above;

in its preferred embodiment, the hand tool forming the subject-matter of the invention works not simply on the principle of the mechanical lever, but with hydraulic power assistance, which greatly reduces the difficulty of the operator's work, for a given force on the active part of the tool. In particular, the axial arrangement of the pump enables it to be operated appropriately whatever orientation is given (for reasons of safety) to the rotating part and to the drive member such as the push bar;

in addition, the hydraulic power assistance gives the active part of the tool a larger stroke, allowing fastenings to be positioned in different positions with respect to the rail, all within the same movement, without the active part of the tool, or even the complete tool, having to be changed to reach these different positions.

BRIEF DESCRIPTION OF THE DRAWINGS

However, a clearer understanding of the invention will be gained from the following description, which refers to the attached diagrammatic drawing showing, by way of example, an embodiment of this hand tool for inserting and removing rail fastenings.

DESCRIPTION OF THE PREFERRED EMBODIMENT

Figure 1:
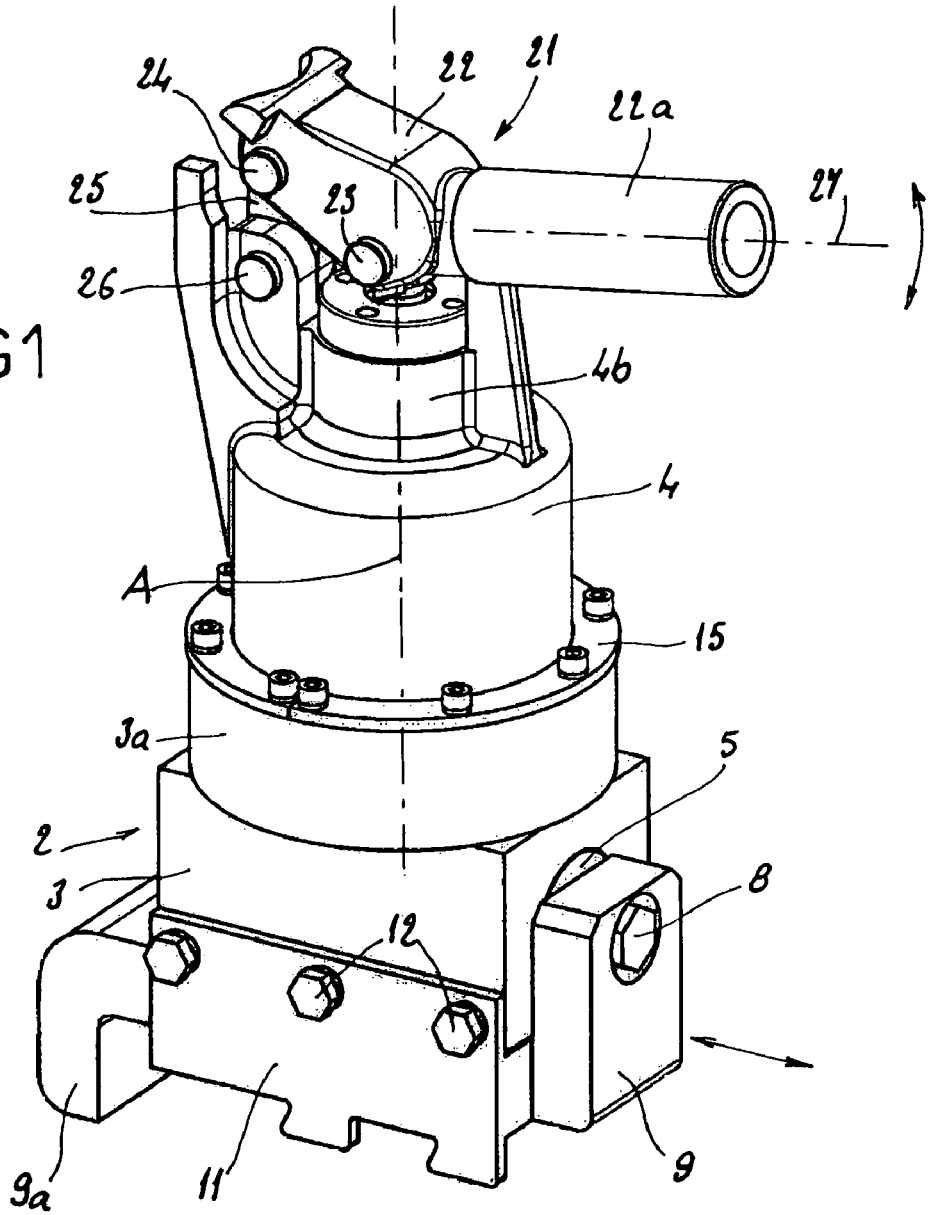
FIG. 1 is a general perspective view of a hand tool in accordance with the present invention.
Figure 2:
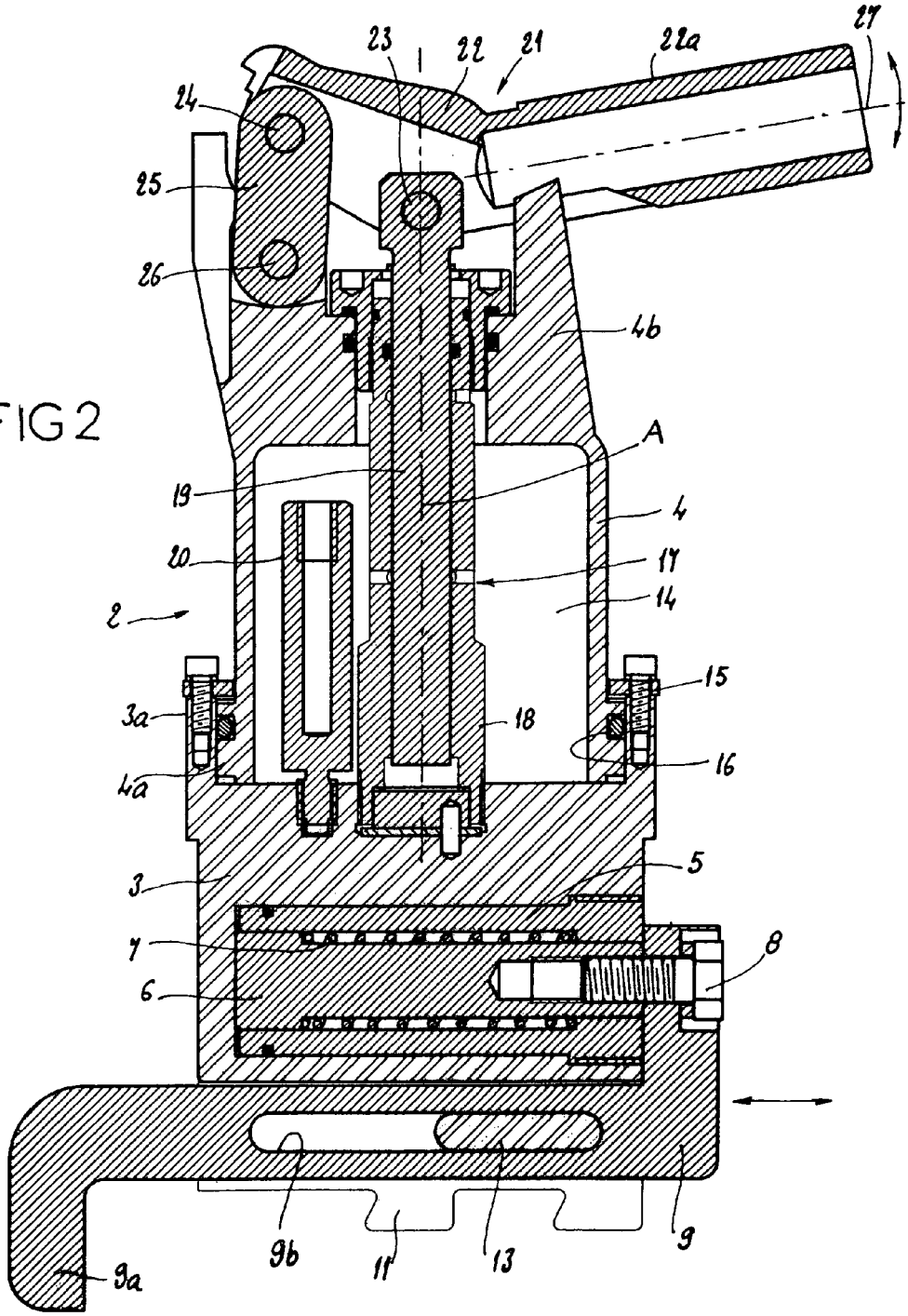
FIG. 2 is a vertical cross section through this tool.

The hand tool for inserting and removing rail fastenings, as shown in the drawing, FIGS. 1 and 2 in particular, is denoted as a whole by the reference number 2. Hand tool 2 comprises a main body consisting of a base block 3 surmounted by a rotating part 4.

The base block 3 houses a fixed cylinder 5, of essentially horizontal axis, in which slides a piston 6, subjected to the action of a restoring spring 7 which pushes the piston 6 towards the closed end of the cylinder 5, the whole forming a hydraulic ram.

To the outward end of the piston 6 there is fixed, by means of a screw 8, an insertion cam 9 which is the active part of the tool and acts on the fastening that is to be inserted or removed, notably by an end 9*a* which is bent down at right angles.

The insertion cam 9 slides on the underside of the base block 3 between two toothed outer plates 11 fixed laterally to either side of the base block 3 by means of screws 12. The insertion cam 9 contains a longitudinal slot 9*b* through which there passes a guiding and retaining member 13, located between the two toothed outer plates 11.

The rotating part 4 of the main body is made hollow in such a way as to define, with the top face of the base block 3, a cylindrical volume forming an oil reservoir 14. The base of the rotating part 4 forms a collar 4*a* in the form of a ring 3*a* mounted so as to rotate on the top of the base block 3, where it is retained by a screwed annular flange 15. A seal 16 of the rotating type is inserted between the collar 4*a* and the upper ring 3*a* of the base block 3.

The rotating part 4, more particularly its reservoir 14, houses along its essentially vertical axis A a pump 17 with a cylindrical body 18 and a plunger piston 19. Also housed inside the reservoir 14 is a safety valve 20.

The rotating part 4 of the main body forms at its top a head 4*b* on which is mounted a device 21 for hand-operating the pump 17. The device 21 comprises a lever 22, of which an intermediate point is hinged about a horizontal axis 23 to the top of the plunger piston 19. One of the arms of the lever 22 is hinged at its end about a longitudinal axis 24 to a link 25 which in turn is hinged about another horizontal axis 26 to the head 4*b* of the rotating part 4. The other arm 22*a* of the lever 22 forms a sleeve, designed to take a removable push bar symbolized by its axis 27.

The hydraulic assembly also includes valves (not shown) necessary for the operation of the pump 17, and internal channels (not shown) drilled into the base block 3, which connect the pump 17 and the oil reservoir 14 to the cylinder 5.

Hand operation of the pump 17 by the operator acting on the push bar 27 injects oil (drawn from the reservoir 14) into the oil chamber of the cylinder 5, in such a way as to push the piston 6 outwards against the action of the restoring spring 7. The insertion cam 9 is thus moved translationally, and can push the fastening to be inserted or removed in the appropriate direction, by its end 9*a*. A control (not detailed) also enables the oil chamber of the cylinder 5 to be put in communication with the reservoir 14, to allow the oil to return to the reservoir 14, the piston 6 being pushed back towards the closed end of the cylinder 5 by its restoring spring 7, and the insertion cam 9 returning to its initial position.

It will also be observed that in the course of use of the hand tool 2, as the succeeding FIGS. 3 to 6 also show, the teeth of the outer plates 11 fit into a shoulder in the fixed support of the fastening, which support is integral with the railroad tie in order to absorb the reaction of the force applied to the fastening. Also, the rotating mounting of the part 4, about an essentially vertical axis A, relative to the base block 3 of the main body of the tool, makes it possible to give any desirable orientation to the rotating part 4, and therefore to the push bar 27, with respect to the base block 3.

FIGS. 3 to 6 illustrate the use of the hand tool 2 described above. These figures show diagrammatically a rail 28 of a railroad, laid on a tie 29, illustrated partially. The rail 28 is fixed to the tie 29 by means of an inner fastening 30 and an outer fastening 31 applied to the respective flange of the foot 28*a* of the rail 28. Each fastening 30 or 31 fits into a fixed support 32 or 33, respectively, embedded in the tie 29. The "inner" side, situated on the right in FIGS. 3 to 6, is here distinguished from the "outer" side, on the left in these figures.

Figure 3:
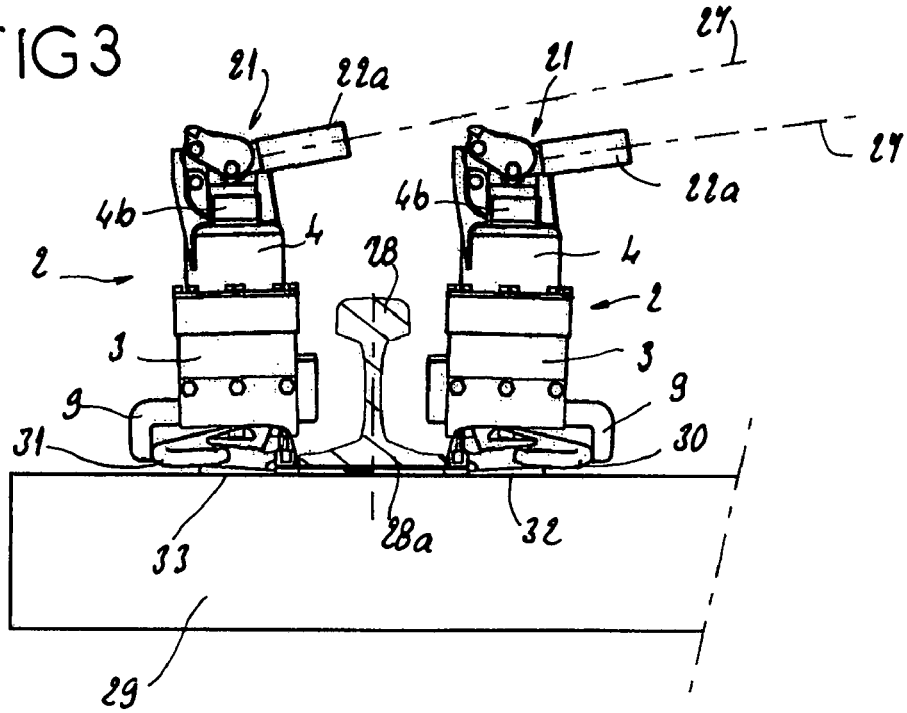
FIGS. 3 and 4 are diagrams illustrating the use of the tool for inserting fastenings.

More particularly, FIG. 3 shows the position of the hand tool 2 at the start of the operation of inserting a fastening 30 or 31. As this figure shows, the angular positions of the base block 3 are diametrically opposed, depending on whether it is an inner fastening 30 or an outer fastening 31 that is being inserted. However, whether it is the inner 30 or outer 31 fastening that is being inserted, the rotating part 4 is always oriented such that the push bar 27 extends inward so that the operator can stand on the railroad, between the rail 28 and the other rail (not shown, further to the right) of this railroad. Furthermore, FIG. 3 clearly shows the initial position of the insertion cam 9.

Figure 4:
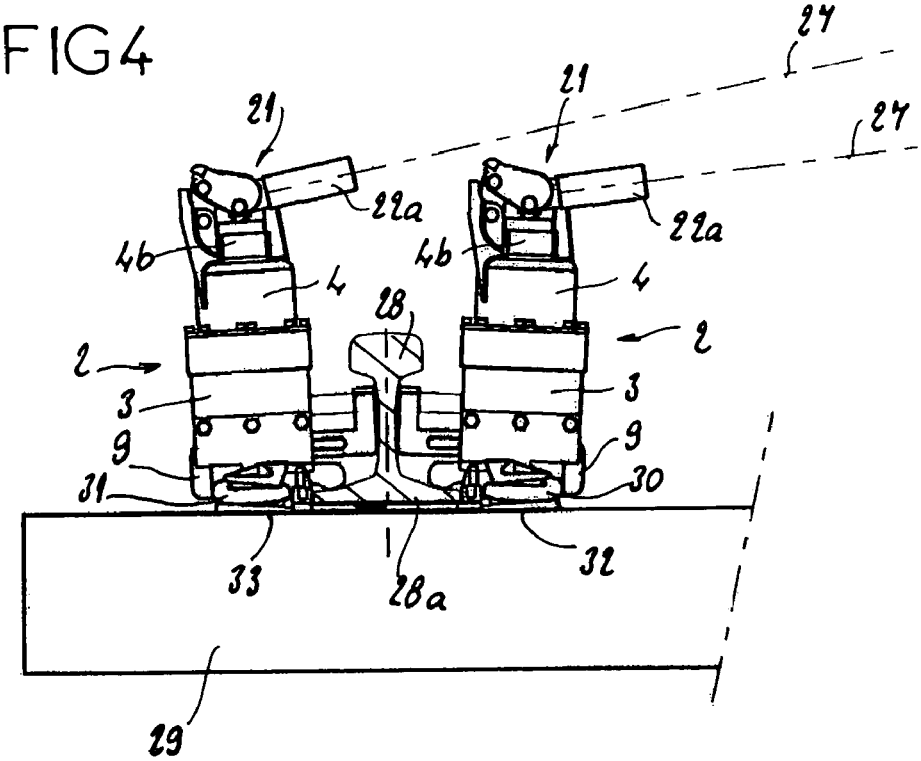

FIG. 4 shows the position of the hand tool 2 for the end of the operation of inserting the fastening 30 or 31, and shows in particular the final position of the insertion cam 9, the piston 6 being part of the way out of the base block 3.

Figure 5:
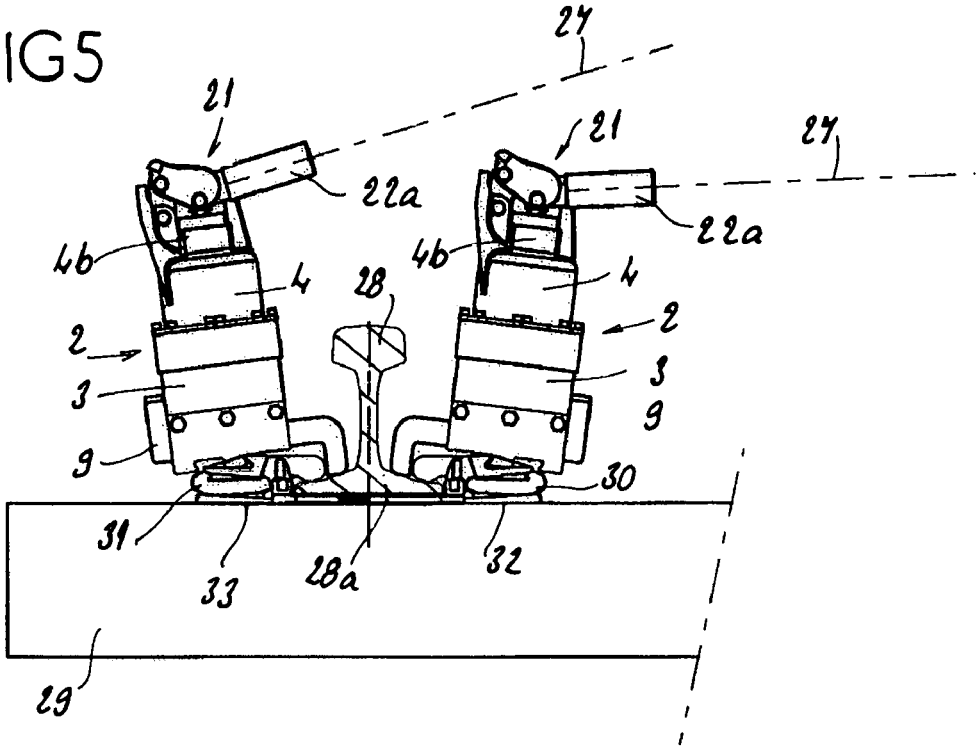
FIGS. 5 and 6 are diagrams similar to the foregoing, but illustrating the use of the same tool for removing fastenings.

FIG. 5 shows the position of the hand tool 2 at the beginning of the operation of extracting a fastening 30 or 31. As this figure shows, the angular positions of the base block 3 are diametrically opposed, depending on whether an inner fastening 30 or an outer fastening 31 is being removed, these positions being furthermore reversed, in comparison with the positions used for the insertion of the fastenings. However, as before, whether it is the inner 30 or outer 31 fastening that is being removed, the rotating part 4 is always oriented such that the push bar 27 extends inward, so that the operator stands on the railroad concerned between the rail 28 and the other rail (not shown, situated further to the right) of this railroad. Furthermore, FIG. 5 clearly shows the initial position of the insertion cam 9.

Figure 6:
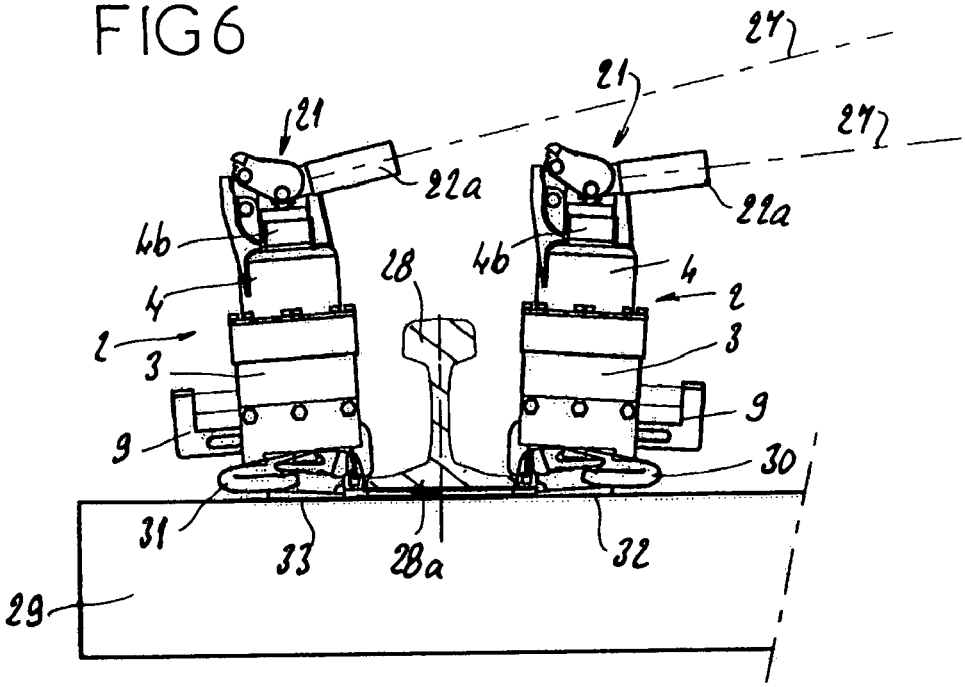

Lastly, FIG. 6 shows the position of the hand tool 2 at the end of the operation of removing the fastening 30 or 31, and shows in particular the final position of the insertion cam 9, the piston 6 being part of the way out of the base block 3.

It will be observed that this insertion cam 9, which is fixed removably by means of the screw 8, can be detached and changed to suit the various different existing types of fastenings and rails, the rest of the hand tool 2 being unchanged.

As is self-evident, and as will be clear from the foregoing account, the invention is not limited only to that embodiment of this hand tool for the insertion and removal of rail fastenings which has been described above by way of example: on the contrary, it encompasses all alternative embodiments and applications that employ the same principle. As particular examples, no departure from the scope of the invention would result from:

modifying the detail shapes of the various parts of the hand tool;

replacing hydraulic power assistance to the operation of the insertion cam with pneumatic power assistance, or mechanical power assistance, for example with a ratchet-controlled speed-reduction device or any other kind of power assistance system capable of amplifying the initial manual effort applied by the operator;

adapting the hand tool, particularly its insertion cam and its toothed outer plates, to any type or size of fastening, fastening support or rail.

The invention claimed is:

1. A hand tool for inserting and removing rail fastenings, particularly for installing and extracting inner or outer elastic fastenings, comprising, in combination:

a main body, an active part designed to act on a fastening that is to be inserted or removed, the active part being mounted movably underneath the main body, at the top of the main body, a rotating part capable of pivoting about an essentially vertical axis, a hand-powered member capable of being mounted on the rotating part and extending to the side of the rotating part when mounted, and a force-multiplying transmission between the hand-powered member and the active part, the rotating part being positionable angularly independently of the use position of the active part, to place the hand-powered member in a suitable orientation, particularly within a safe zone.

2. The hand tool as claimed in claim 1, in which the main body comprises a base block housing a hydraulic ram, the moving part of which is connected to the active part designed to act on the fastening that is to be inserted or removed, and a rotating part that surmounts the base block and encloses a hydraulic power unit with an oil reservoir and a pump, in communication with the hydraulic ram, the rotating part having at a top a head provided with a device for the hand operation of the pump, with a hand-powered member and transmission parts between this power member and the moving part of the pump.

3. The hand tool as claimed in claim 2, in which the hydraulic ram comprises a fixed cylinder, housed in the base block of the main body, and a sliding piston which possesses an outer end to which the active part is removably and interchangeably fixed.

4. The hand tool as claimed in claim 3, in which the active part of this tool is an insertion cam acting on the fastening that is to be inserted or removed via an end bent down at right angles, the insertion cam being mounted so as to slide between two toothed outer plates fixed laterally on either side of the base block.

5. The hand tool as claimed in claim 4, in which the hand operated device is constructed with a lever able to move in an essentially vertical plane, one arm of which is designed to take the hand-powered member and one point of which is connected to a plunger piston of a pump set essentially vertically, in the axis of the rotating part.

6. The hand tool as claimed in claim 4, wherein the rotating part of the main body is hollowed to define, with the top face of the base block, a cylindrical volume that forms the oil reservoir.

7. The hand tool as claimed in claim 3, in which the hand operated device is constructed with a lever able to move in an essentially vertical plane, one arm of which is designed to take the hand-powered member and one point of which is connected to a plunger piston of a pump set essentially vertically, in the axis of the rotating part.

8. The hand tool as claimed in claim 3, wherein the rotating part of the main body is hollowed to define, with the top face of the base block, a cylindrical volume that forms the oil reservoir.

9. The hand tool as claimed in claim 3, in which the base of the rotating part forms a collar in the form of a ring mounted so as to rotate on the top of the base block, wherein the base is retained by an annular flange, a seal of the rotating type being inserted between the collar and the upper ring of the base block.

10. The hand tool as claimed in claim 4, in which the base of the rotating part forms a collar in the form of a ring mounted so as to rotate on the top of the base block, wherein the base is retained by an annular flange, a seal of the rotating type being inserted between the collar and the upper ring of the base block.

11. The hand tool as claimed in claim 2, in which the hand operated device is constructed with a lever able to move in an essentially vertical plane, one arm of which is designed to take the hand-powered member and one point of which is connected to a plunger piston of a pump set essentially vertically, in the axis of the rotating part.

12. The hand tool as claimed in claim 11, wherein another point of the lever is connected in a hinged manner, via a link, to the head of the rotating part.

13. The hand tool as claimed in claim 12, wherein the rotating part of the main body is hollowed to define, with the top face of the base block, a cylindrical volume that forms the oil reservoir.

14. The hand tool as claimed in claim 12, in which the base of the rotating part forms a collar in the form of a ring mounted so as to rotate on the top of the base block, wherein the base is retained by an annular flange, a seal of the rotating type being inserted between the collar and the upper ring of the base block.

15. The hand tool as claimed in claim 11, wherein the rotating part of the main body is hollowed to define, with the top face of the base block, a cylindrical volume that forms the oil reservoir.

16. The hand tool as claimed in claim 11, in which the base of the rotating part forms a collar in the form of a ring mounted so as to rotate on the top of the base block, wherein the base is retained by an annular flange, a seal of the rotating type being inserted between the collar and the upper ring of the base block.

17. The hand tool as claimed in claim 2, wherein the rotating part of the main body is hollowed to define, with the top face of the base block, a cylindrical volume that forms the oil reservoir.

18. The hand tool as claimed in claim 17, in which the base of the rotating part forms a collar in the form of a ring mounted so as to rotate on the top of the base block, wherein the base is retained by an annular flange, a seal of the rotating type being inserted between the collar and the upper ring of the base block.

19. The hand tool as claimed in claim 2, in which the base of the rotating part forms a collar in the form of a ring mounted so as to rotate on the top of the base block, wherein the base is retained by an annular flange, a seal of the rotating type being inserted between the collar and the upper ring of the base block.

* * * * *